US011213932B2

(12) United States Patent
Drivdahl et al.

(10) Patent No.: US 11,213,932 B2
(45) Date of Patent: Jan. 4, 2022

(54) DIAMOND BODIES AND TOOLS FOR GRIPPING DRILL RODS

(71) Applicant: BLY IP INC., Salt Lake City, UT (US)

(72) Inventors: Kristian S. Drivdahl, Park City, UT (US); Cody A. Pearce, Midvale, UT (US); Robert Corona, Salt Lake City, UT (US); Christopher L. Drenth, Burlington (CA); Anthony Lachance, Burlington (CA)

(73) Assignee: BLY IP INC., Salt Lake City, UT (US)

( * ) Notice: Subject to any disclaimer, the term of this patent is extended or adjusted under 35 U.S.C. 154(b) by 0 days.

(21) Appl. No.: 16/636,363

(22) PCT Filed: Aug. 3, 2018

(86) PCT No.: PCT/US2018/045077

§ 371 (c)(1),
(2) Date: Feb. 4, 2020

(87) PCT Pub. No.: WO2019/028299

PCT Pub. Date: Feb. 7, 2019

(65) Prior Publication Data

US 2020/0164492 A1 May 28, 2020

Related U.S. Application Data

(60) Provisional application No. 62/541,197, filed on Aug. 4, 2017.

(51) Int. Cl.
*B25B 13/50* (2006.01)
*B25B 13/58* (2006.01)
(Continued)

(52) U.S. Cl.
CPC ..... *B25B 13/505* (2013.01); *B25B 13/58* (2013.01); *B25B 13/16* (2013.01); *B25B 13/28* (2013.01); *B25B 13/52* (2013.01); *E21B 19/00* (2013.01)

(58) Field of Classification Search
CPC ..... B25B 13/505; B25B 13/58; B25B 13/16; B25B 13/28; B25B 13/52; E21B 19/00
(Continued)

(56) References Cited

U.S. PATENT DOCUMENTS 1,906,696 A * 5/1933 Lynch ..... E21B 19/161 81/90.5
3,306,280 A 2/1967 Vannoy
(Continued)

FOREIGN PATENT DOCUMENTS

AU 2012214291 2/2012
AU 2017258988 2/2012
(Continued)

OTHER PUBLICATIONS

U.S. Appl. No. 62/541,197, filed Aug. 4, 2017, Kristian S. Drivdahl.
(Continued)

*Primary Examiner* — Hadi Shakeri
(74) *Attorney, Agent, or Firm* — Ballard Spahr LLP

(57) ABSTRACT

Infiltrated diamond bodies for use in gripping drill rods and other tubulars. One example of such an infiltrated diamond body is a cast diamond roller having a plurality of pads that are separated by channels. Another example of such an infiltrated diamond body is a cast wrench jaw having at least one raised jaw pad.

21 Claims, 12 Drawing Sheets

(51) Int. Cl.

| | |
|---|---|
| ***B25B 13/16*** | (2006.01) |
| ***B25B 13/28*** | (2006.01) |
| ***B25B 13/52*** | (2006.01) |
| ***E21B 19/00*** | (2006.01) |

(58) Field of Classification Search
USPC ..... 81/90.1–90.9, 99
See application file for complete search history.

(56) References Cited

U.S. PATENT DOCUMENTS

| | | | | |
|---|---|---|---|---|
| 4,604,106 | A | 8/1986 | Hall | |
| 4,630,692 | A | 12/1986 | Ecer | |
| 5,000,273 | A * | 3/1991 | Horton | C04B 35/52 175/433 |
| 5,030,276 | A | 7/1991 | Sung et al. | |
| 5,096,465 | A | 3/1992 | Chen et al. | |
| 5,172,613 | A * | 12/1992 | Wesch, Jr. | B25B 13/5075 81/57.11 |
| 5,178,645 | A | 1/1993 | Nakamura et al. | |
| 5,304,342 | A | 4/1994 | Hall, Jr. et al. | |
| 6,176,888 | B1 | 1/2001 | Ritt et al. | |
| 6,214,079 | B1 | 4/2001 | Kear et al. | |
| 6,302,410 | B1 | 10/2001 | Wentworth et al. | |
| 6,336,381 | B2 * | 1/2002 | McDonnell | B25B 13/505 81/57.12 |
| 6,620,035 | B2 * | 9/2003 | Xu | B24B 21/04 451/307 |
| 6,951,578 | B1 | 10/2005 | Belnap et al. | |
| 7,036,397 | B2 * | 5/2006 | Bangert | E21B 19/07 81/57.15 |
| 7,600,450 | B2 * | 10/2009 | Montgomery | E21B 19/07 175/423 |
| 7,997,166 | B2 * | 8/2011 | Lauzon | E21B 19/161 81/57.34 |
| 7,997,167 | B2 * | 8/2011 | Kruse | E21B 19/161 81/57.34 |
| 8,496,238 | B1 * | 7/2013 | Orgeron | B25B 5/147 269/270 |
| 9,421,671 | B2 | 8/2016 | Rupp et al. | |
| 2004/0159471 | A1 | 8/2004 | Azar et al. | |
| 2005/0188793 | A1 * | 9/2005 | Cherry | E21B 19/164 81/57.33 |
| 2005/0263328 | A1 | 12/2005 | Middlemiss | |
| 2008/0128170 | A1 | 6/2008 | Drivdahl et al. | |
| 2008/0282618 | A1 | 11/2008 | Lockwood | |
| 2009/0229424 | A1 | 9/2009 | Montgomery et al. | |
| 2010/0218999 | A1 | 9/2010 | Jones et al. | |
| 2011/0030440 | A1 | 2/2011 | Keane et al. | |
| 2011/0031037 | A1 | 2/2011 | Bellin et al. | |
| 2012/0199402 | A1 | 8/2012 | Rupp et al. | |
| 2013/0098691 | A1 * | 4/2013 | Pearce | E21B 10/46 175/425 |
| 2016/0115750 | A1 | 4/2016 | Jelgert et al. | |
| 2016/0348443 | A1 | 12/2016 | Rupp et al. | |

FOREIGN PATENT DOCUMENTS

| | | | |
|---|---|---|---|
| AU | 2016201337 | | 3/2016 |
| CA | 2826758 | | 2/2012 |
| CL | 2013-02330 | | 2/2012 |
| CN | 2521373 | Y | 11/2002 |
| CN | 1904306 | A | 1/2007 |
| CN | 101100930 | A | 1/2008 |
| CN | 101198762 | A | 6/2008 |
| CN | 201280017596.5 | | 2/2012 |
| CN | 201510800449.0 | | 11/2015 |
| EP | 0733776 | A2 | 9/1996 |
| EP | 1077268 | A1 | 2/2001 |
| EP | 12744403.2 | | 2/2012 |
| GB | 2398316 | B | 4/2005 |
| PE | 1851.13 | | 2/2012 |
| WO | PCT/US2012/024539 | | 2/2012 |
| WO | WO-2012/109479 | A2 | 8/2012 |
| WO | PCT/US2018/045077 | | 8/2018 |
| WO | WO-2019/028299 | A1 | 2/2019 |
| ZA | 2013/06742 | | 2/2012 |

OTHER PUBLICATIONS

U.S. Appl. No. 61/441,189, filed Feb. 9, 2011, Michael D. Rupp.
U.S. Appl. No. 13/368,928, filed Feb. 8, 2012, Michael D. Rupp.
U.S. Appl. No. 15/232,452, filed Aug. 9, 2016, Michael D. Rupp.
International Search Report and Written Opinion were dated Jan. 2, 2019 by the International Searching Authority for International Application No. PCT/US2018/045077, filed on Aug. 3, 2018 and published as WO 2019/028299 on Feb. 7, 2019 (Applicant-Bly IP Inc.) (8 Pages).
International Search Report and Written Opinion were dated Sep. 24, 2012 by the International Searching Authority for International Application No. PCT/US2012/024539, filed on Feb. 9, 2012 and published as WO 2012/109479 on Aug. 16, 2012 (Applicant-Longyear TM, Inc.) (9 Pages).
International Preliminary Report on Patentability was dated Aug. 13, 2013 by the International Searching Authority for International Application No. PCT/US2012/024539, filed on Feb. 9, 2012 and published as WO 2012/109479 on Aug. 16, 2012 (Applicant-Longyear TM, Inc.) (6 Pages).
European Search Report and Written Opinion were dated Dec. 5, 2017 by the European Patent Office for EP Application No. 12744403 , filed on Feb. 9, 2012 and published as EP 2673454 A2 on Dec. 18, 2013 (Applicant-Longyear TM, Inc.) (4 Pages).
Office Action was dated Sep. 2, 2014 by the SIPO for CN Application No. 201280017596 , filed on Feb. 9, 2012 and Granted as CN 103459751 B on Dec. 23, 2015 (Applicant-Longyear TM, Inc) (13 Pages).
Office Action was dated Mar. 20, 2015 by the SIPO for CN Application No. 201280017596 , filed on Feb. 9, 2012 and Granted as CN 103459751 B on Dec. 23, 2015 (Applicant-Longyear TM, Inc) (14 Pages).
Notification to Grant Patent Right for Invention was dated Sep. 8, 2015 by the SIPO for CN Application No. 201280017596 , filed on Feb. 9, 2012 and Granted as CN 103459751 B on Dec. 23, 2015 (Applicant-Longyear TM, Inc) (2 Pages).
Office Action was dated Jan. 26, 2017 by the SIPO for CN Application No. 201280017596 , filed on Feb. 9, 2012 and Granted as CN 105328588 B on Jun. 19, 2018 (Applicant-Longyear TM, Inc) (11 Pages).
Office Action was dated Oct. 23, 2017 by the SIPO for CN Application No. 201280017596 , filed on Feb. 9, 2012 and Granted as CN 105328588 B on Jun. 19, 2018 (Applicant-Longyear TM, Inc) (6 Pages).
Non Final Rejection was dated Jun. 27, 2014 by the USPTO for U.S. Appl. No. 13/368,928, filed Feb. 8, 2012 and granted as U.S. Pat. No. 9,421,671 on Aug. 23, 2016 (Inventor-Michael D. Rupp) (7 Pages).
Response to Non Final Rejection was dated Sep. 29, 2014 to the USPTO for U.S. Appl. No. 13/368,928, filed Feb. 8, 2012 and granted as U.S. Pat. No. 9,421,671 on Aug. 23, 2016 (Inventor-Michael D. Rupp) (12 Pages).
Final Rejection was dated Nov. 4, 2014 by the USPTO for U.S. Appl. No. 13/368,928, filed Feb. 8, 2012 and granted as U.S. Appl. No. 9,421,671 on Aug. 23, 2016 (Inventor-Michael D. Rupp) (8 Pages).
Response to Final Rejection and RCE was dated Feb. 3, 2015 to the USPTO for U.S. Appl. No. 13/368,928, filed Feb. 8, 2012 and granted as U.S. Pat. No. 9,421,671 on Aug. 23, 2016 (Inventor-Michael D. Rupp) (15 Pages).
Non Final Rejection was dated Mar. 17, 2015 by the USPTO for U.S. Appl. No. 13/368,928, filed Feb. 8, 2012 and granted as U.S. Pat. No. 9,421,671 on Aug. 23, 2016 (Inventor-Michael D. Rupp) (11 Pages).
Response to Non Final Rejection was dated Jul. 17, 2015 to the USPTO for U.S. Appl. No. 13/368,928, filed Feb. 8, 2012 and granted as U.S. Pat. No. 9,421,671 on Aug. 23, 2016 (Inventor-Michael D. Rupp) (11 Pages).

(56) References Cited

OTHER PUBLICATIONS

Final Rejection was dated Aug. 4, 2015 by the USPTO for U.S. Appl. No. 13/368,928, filed Feb. 8, 2012 and granted as U.S. Pat. No. 9,421,671 on Aug. 23, 2016 (Inventor-Michael D. Rupp) (17 Pages).
Response to Final Rejection and RCE was dated Nov. 4, 2015 to the USPTO for U.S. Appl. No. 13/368,928, filed Feb. 8, 2012 and granted as U.S. Pat. No. 9,421,671 on Aug. 23, 2016 (Inventor-Michael D. Rupp) (14 Pages).
Non Final Rejection was dated Dec. 10, 2015 by the USPTO for U.S. Appl. No. 13/368,928, filed Feb. 8, 2012 and granted as U.S. Pat. No. 9,421,671 on Aug. 23, 2016 (Inventor-Michael D. Rupp) (17 Pages).
Response to Non Final Rejection was dated Apr. 11, 2016 to the USPTO for U.S. Appl. No. 13/368,928, filed Feb. 8, 2012 and granted as U.S. Pat. No. 9,421,671 on Aug. 23, 2016 (Inventor-Michael D. Rupp) (13 Pages).
Notice of Allowance was dated May 6, 2016 by the USPTO for U.S. Appl. No. 13/368,928, filed Feb. 8, 2012 and granted as U.S. Pat. No. 9,421,671 on Aug. 23, 2016 (Inventor-Michael D. Rupp) (7 Pages).
Issue Notification was dated Aug. 3, 2016 by the USPTO for U.S. Appl. No. 13/368,928, filed Feb. 8, 2012 and granted as U.S. Pat. No. 9,421,671 on Aug. 23, 2016 (Inventor-Michael D. Rupp) (1 Page).
Non Final Rejection was dated Dec. 8, 2017 by the USPTO for U.S. Appl. No. 15/232,452, filed Aug. 9, 2016 and published as US-2016/0348443-A1 on Dec. 1, 2016 (Inventor-Michael D. Rupp) (9 Pages).
Response to Non Final Rejection was dated Mar. 8, 2018 to the USPTO for U.S. Appl. No. 15/232,452, filed Aug. 9, 2016 and published as US-2016/0348443-A1 on Dec. 1, 2016 (Inventor-Michael D. Rupp) (8 Pages).
Abandonment was issued on Jan. 4, 2019 by the USPTO for U.S. Appl. No. 15/232,452, filed Aug. 9, 2016 and published as US-2016/0348443-A1 on Dec. 1, 2016 (Inventor-Michael D. Rupp) (2 Pages).

* cited by examiner

DIAMOND BODIES AND TOOLS FOR GRIPPING DRILL RODS

CROSS-REFERENCE TO RELATED APPLICATION

This is a U.S. National Phase Application of International Application No. PCT/US2018/045077, filed Aug. 3, 2018, which claims the benefit of U.S. Provisional Application No. 62/541,197 filed Aug. 4, 2017. Both of the above-identified applications are incorporated herein by reference in their entirety.

BACKGROUND

Field

The present invention generally relates to tools, such as drilling, mining, and industrial tools. More particularly, the present invention relates to gripping tools and to methods of making and using such tools.

Discussion of the Relevant Art

Drill rod handling equipment often includes grippers or rollers for engaging drill rods during the rod handling process. An example of such a gripper/roller is provided in FIG. 1B. As shown, this conventional gripper/roller construction includes spaced rows of aligned gripping features that frequently cause skipping and drill rod damage during rod handling operations. More particularly, the gripping features of conventional grippers/rollers are typically large carbide teeth that dig deep into drill rods during the drill rod handling process. This deep digging action is very destructive to the strength and reliability of the drill rod and often leads to premature cracking of the drill rods. An example of a drill rod damaged by a conventional gripper/roller is provided in FIG. 2.

There are also problems with conventional wrench jaws, which are typically provided with poorly bonded, fast-wearing carbide grit. Frequently, the carbide grit of these wrench jaws damages drill rods and other tubing that is handled by the wrench jaws. The carbide grit is also very expensive and prone to early failure.

Accordingly, there exists a need for a new composition for lower cost rod handling tools that avoid or minimize damage to drill rods while maintaining or improving upon the gripping action and productivity of conventional rod handling tools, such as grippers/rollers and wrenches.

SUMMARY

Implementations of the present disclosure can overcome one or more of the foregoing or other problems in the art with tools, systems, and methods including gripping bodies or substrates. In various aspects, disclosed herein is a gripping tool that comprises at least one cast gripping portion. Each cast gripping portion can comprise a matrix and a binder. The matrix can have a hard particulate material and a plurality of diamond particles dispersed throughout the hard particulate material. The binder can secure the hard particulate material and the diamond particles together. The diamond particles can comprise between about 25% by volume and about 75% by volume of each cast gripping portion.

Optionally, in some exemplary aspects, the gripping tool can be a gripping roller, and the at least one cast gripping portion can comprise a plurality of contact pads positioned on an outer surface of the gripping roller. Optionally, the gripping roller can be cast together with the plurality of contact pads. Optionally, the plurality of contact pads can be positioned in a spiral configuration and spaced apart by a plurality of channels.

Optionally, in other exemplary aspects, the gripping tool can be a wrench having at least two jaws. In these aspects, the at least one gripping portion can comprise three gripping pads positioned on the at least two jaws. In one configuration, the at least two jaws include a first jaw and a second jaw, with the first jaw being cast together with first and second gripping pads and the second jaw being cast together with a third gripping pad. In another configuration, the at least two jaws include first, second, and third jaws, with each jaw being cast together with a respective gripping pad.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figures 1A, 1B:
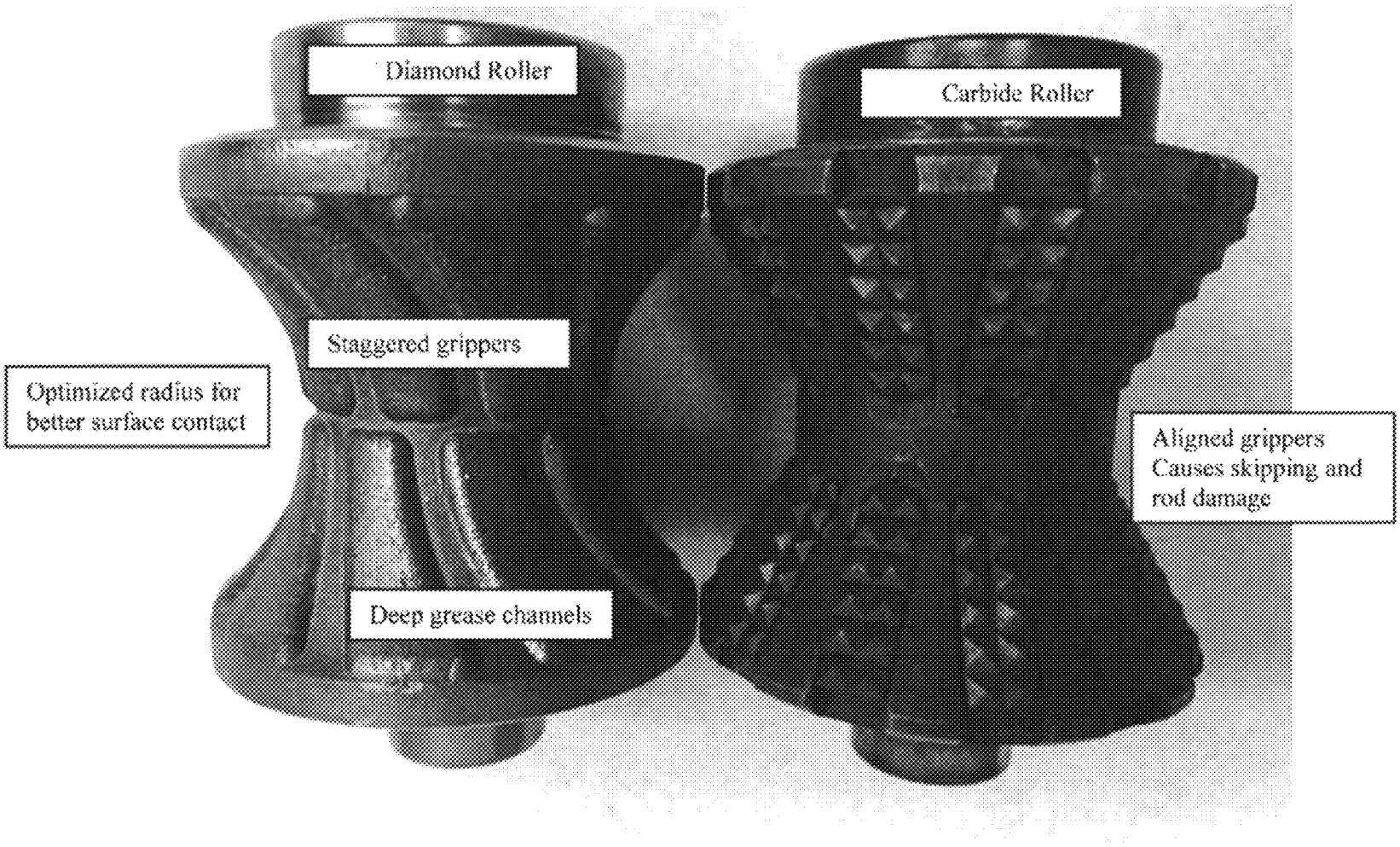
(Prior Art) FIG. 1B
FIGS. 1A-1B illustrates side-by-side comparison images of a conventional carbide roller (FIG. 1B) and an exemplary diamond roller as disclosed herein (FIG. 1A)
Figure 2:
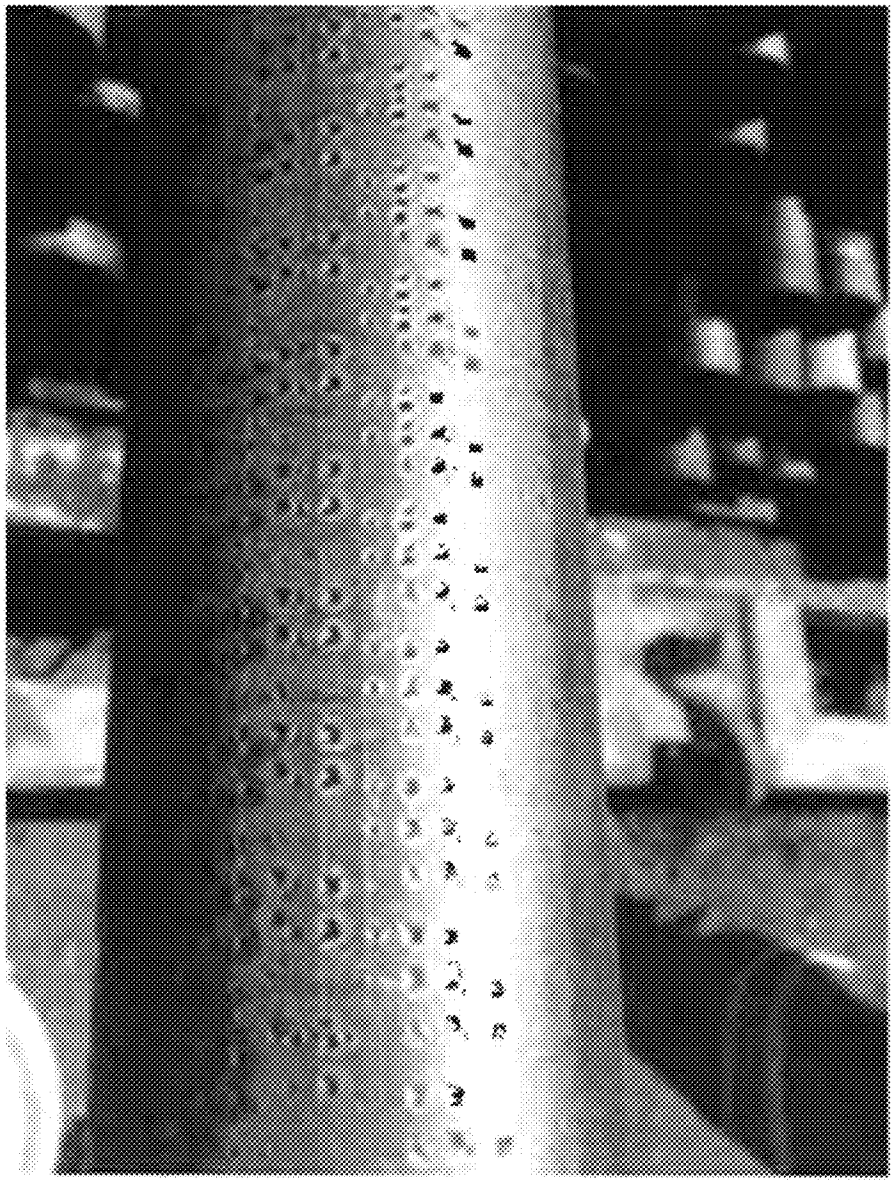
(Prior Art) FIG. 2
FIG. 2 is an image of a drill rod that has been damaged by the large carbide teeth of a conventional carbide roller.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a raised pad" can include two or more such raised pads unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about" or "substantially," it is contemplated that values within up to 15%, up to 10%, or up to 5% (above or below) of the particularly stated value or characteristic can be included within the scope of those aspects.

As used herein, the terms "optional" or "optionally" mean that the subsequently described event or circumstance may or may not occur, and that the description includes instances where said event or circumstance occurs and instances where it does not.

As used herein, the term "cast," when used as an adjective, refers to a component that is formed using a casting process as is known in the art, in which the component is solidified within a mold to impart a desired structure. In exemplary aspects, such cast components can be formed using the specific casting processes disclosed in detail herein.

Implementations of the disclosure are directed towards tools, systems, and methods including bodies or substrates formed from infiltrated diamond mixtures. In particular, one or more implementations of the disclosure include a body comprising infiltrated diamond mixtures with a binder. The infiltrated diamond mixtures can provide the body with increased gripping power and reliability over steel and tungsten carbide bodies. Additionally, the infiltrated diamond mixtures can provide the body with increased ductility compared to tungsten carbide and other cermet bodies. Furthermore, the infiltration process can allow for a wide variety of body shapes.

In other words, one or more implementations of the disclosure can replace tungsten carbide (or other cermet) bodies or hard-facing with infiltrated diamond bodies or tools as the primary gripping material. In use, it is contemplated that the infiltrated diamond bodies and tools disclosed herein can reduce damage to drill rods (and other tubing) while providing improved gripping and wear-resistance compared to conventional tungsten carbide products. Furthermore, the binder can be tailored to achieve the required ductility for a particular application. In addition to the foregoing, the use of diamond concentrations as disclosed herein can preclude the need for hand set wear elements, such as the large carbide teeth that are typically provided on rod handler rollers/grippers.

In particular, one or more implementations include infiltrated diamond bodies. The infiltrated diamond bodies can comprise diamond particles. The diamond particles can include one or more of natural diamonds, synthetic diamonds, polycrystalline diamond products (i.e., TSD or PCD), etc. In one or more implementations, the diamond particles can comprise the primary component of the infiltrated diamond body by volume, and thus, the primary defense against wear and erosion of the infiltrated diamond body.

Infiltrated diamond bodies of one or more implementations can form at least a portion of any number of different tools, particularly tools that have need for applying gripping force. For example, the infiltrated diamond bodies can be part of tools used to securely grip a drill rod or other tubular member (e.g., an inner tube, an outer tube, and the like) during a coring operation. These tools may include, for example, rollers/grippers (for use in rod handling applications), wrenches (for use in rod handling or rod transport), and drill rod chucks (i.e., chuck jaws or inserts for engaging and gripping drill rods during various operations, including active drilling and rod loading/unloading). The Figures and corresponding text included hereafter illustrate examples of drilling tools including infiltrated diamond bodies, and methods of forming and using such tools. This has been done for ease of description. One will appreciate in light of the disclosure herein; however, that the systems, methods, and apparatus of the present invention can be used with other tools. For example, implementations of the present invention can be used to form any type of tool that must apply a strong gripping force. In one or more implementations, the infiltrated diamond bodies can replace tungsten carbide hard-facing.

Figure 9:
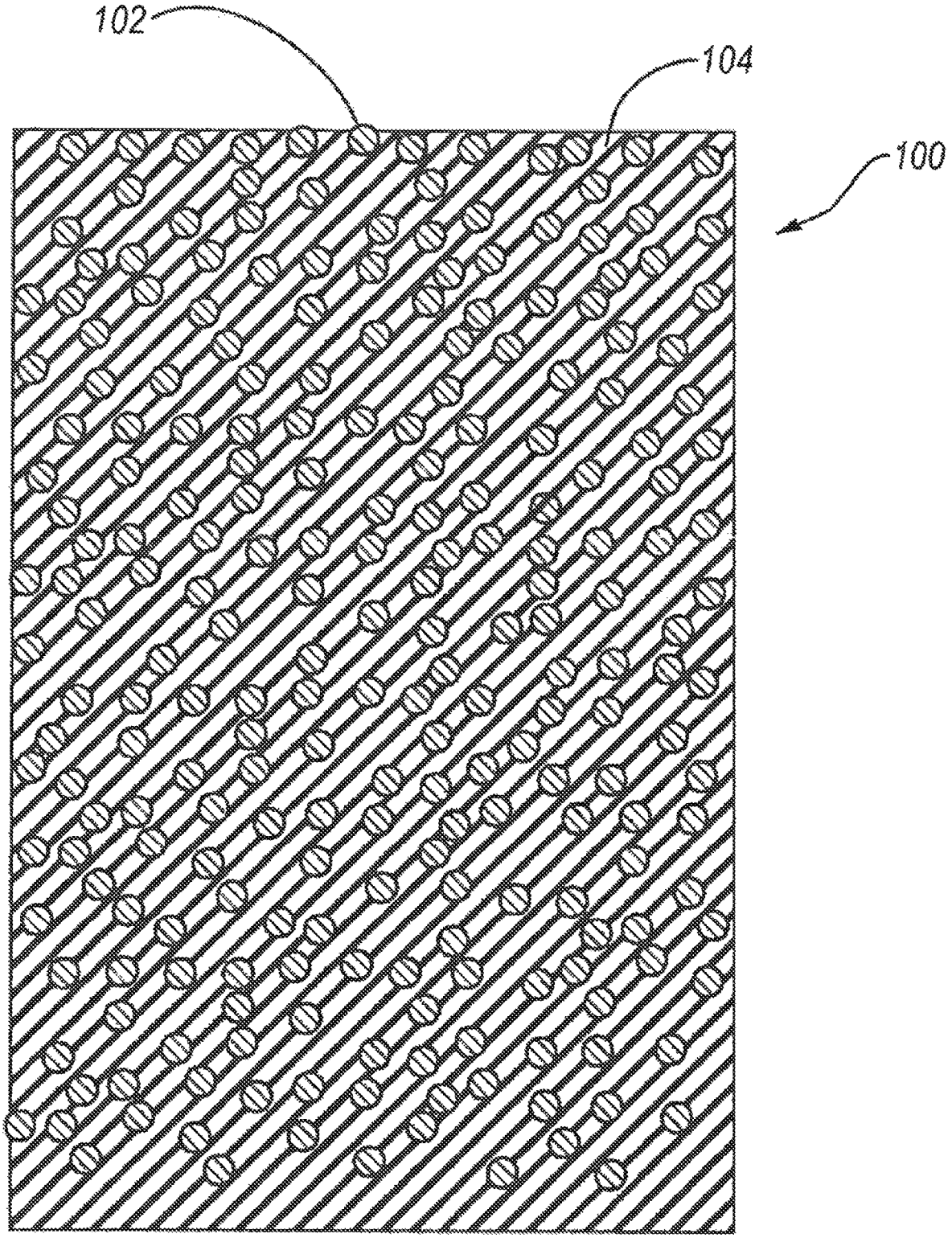
FIG. 9 is a cross-sectional view of an exemplary infiltrated diamond body as disclosed herein.

Referring now to the Figures, FIG. 9 illustrates a cross-sectional view of an infiltrated diamond body 100 in accordance with one or more implementations of the present invention. As shown in FIG. 9, the infiltrated diamond body 100 can comprise diamond 102 held together by a binder 104. One will appreciate in light of the disclosure herein, that the diamond 102 can replace a powdered metal or alloy, such as tungsten carbide used in many conventional tools. Alternatively, the infiltrated diamond body 100 can replace a steel body or component in a conventional tool. In still further implementations, the infiltrated diamond body 100 can replace tungsten carbide hard-facing.

The diamond 102 can comprise one or more of natural diamonds, synthetic diamonds, polycrystalline diamond products (i.e., TSD or PCD), and the like. The diamond 102 can comprise a wide number sizes, shapes, grain, quality, grit, concentration, etc. as explained in greater detail below. In any event, the diamond 102 can comprise at least 25% volume of the infiltrated diamond body 100. For example, the diamond 102 can comprise between about 25% and about 75% volume of the infiltrated diamond body 100. In one or more implementations, the diamond 102 can comprise the primary component of the infiltrated diamond body 100. In other words, the percent volume of the diamond 102 can be greater than percent volume any of the other individual components (binder 104, hard particulate material etc.) of the infiltrated diamond body 100. As used herein, the term "infiltrated diamond body" refers to the portion of a gripping feature of a tool through which diamond is dispersed as further disclosed herein. For example, a contact pad or contact strap formed of an infiltrated diamond mixture can be an "infiltrated diamond body" while underlying portions of a tool that are completely devoid of diamond are not part of the "infiltrated diamond body." As another example, if a gripping jaw of a wrench has diamond dispersed throughout the jaw, then the entire gripping jaw can be considered an "infiltrated diamond body."

More specifically, in one or more implementations the diamond 102 can comprise between about 30% and 70% by volume of the infiltrated diamond body 100. In further implementations, the diamond 102 can comprise between about 40% and 60% by volume of the infiltrated diamond body 100. In still further implementations, the diamond 102 can comprise about 25%, 30%, 35%, 40%, 45%, 50%, 55%, 60%, 65%, 70%, or 75% by volume of the infiltrated diamond body 100. Recitation of ranges of values herein are merely intended to serve as a shorthand method of referring individually to each separate value falling within the range, unless otherwise indicated herein, and each separate value is incorporated into the specification as if it were individually recited herein.

Optionally, in one or more implementations, the diamond 102 can be homogenously dispersed throughout the infiltrated diamond body 100. In alternative implementations, however, the concentration of diamond 102 can vary throughout the infiltrated diamond body 100, as desired. Indeed, as explained below the concentration of diamond 102 can vary depending upon the desired characteristics for the infiltrated diamond body 100. For example, a large concentration of diamond 102 can be placed in portions of the infiltrated diamond body 100 where gripping force is to be applied (and which are particularly susceptible to wear), such as the outer surfaces. The size, density, and shape of the diamond 102 can be provided in a variety of combinations depending on desired cost and performance of the infiltrated diamond body 100. For example, the infiltrated diamond body 100 can comprise sections, strips, spots, rings, or any other formation that contains a different concentration or mixture of diamond than other parts of the infiltrated diamond body 100. For instance, the outer portion of the infiltrated diamond body 100 may contain a first concentration of diamond 102, and the concentration of diamond 102 can gradually decrease or increase towards an inner portion of the infiltrated diamond body 100.

In one or more implementations the diamond 102 comprises particles, such as natural diamond crystals or synthetic diamond crystals. The diamond 102 can thus be relatively small. In particular, in one or more implementation, the diamond 102 has a largest dimension less than about 2 millimeters, or more preferably between about 0.01 millimeters and about 1.0 millimeters. Additionally or alternatively, a volume that is less between about 0.001 $mm^3$ and about 8 $mm^3$. In alternative implementations, the diamond 102 can have a largest dimension more than about 2 millimeters and/or a volume more that about 8 $mm^3$.

Optionally, in some aspects, the diamond within each infiltrated diamond body 100 can comprise diamond 102 of at least two different mesh sizes. For example, in these aspects, it is contemplated that the infiltrated diamond body 100 can comprise 2, 3, 4, 5, 6, 7, 8, 9, 10, 11, or 12 different mesh sizes. Exemplary mesh sizes for the diamond include 20/25, 25/30, 25/35, 30/35, 30/40, 35/40, 40/45, 40/50, 50/60, 55/70, 60/70, and 70/80 (listed from largest to smallest). Optionally, in exemplary aspects, where two different mesh sizes are provided, it is contemplated that the volume ratio between the larger mesh size and the smaller mesh size can be greater than 1:1 or, more preferably, greater than 1.5:1.

In one or more implementations, the diamond 102 can include a coating of one or more materials. The coating can include metal, ceramic, polymer, glass, other materials or combinations thereof. For example, the diamond 102 can be coated with a metal, such as iron, titanium, nickel, copper, molybdenum, lead, tungsten, aluminum, chromium, or combinations or alloys thereof. In other implementations, diamond 102 may be coated with a ceramic material, such as SiC, SiO, $SiO_2$, or the like.

The coating may cover all of the surfaces of the diamond 102, or only a portion thereof. Additionally, the coating can be of any desired thickness. For example, in one or more implementations, the coating may have a thickness of about one to about 20 microns. The coating may be applied to the diamond 102 through spraying, brushing, electroplating, immersion, vapor deposition, or chemical vapor deposition. The coating can help bond the diamond 102 to the binder or hard particulate material. Still further, or alternatively, the coating can increase or otherwise modify the wear properties of the diamond 102.

In yet further implementations, the infiltrated diamond body 100 can also comprise a traditional hard particulate material in addition to the diamond 102. For example, the infiltrated diamond body 100 can comprise a powdered material, such as for example, a powdered metal or alloy, as well as ceramic compounds. According to one or more implementations of the present invention the hard particulate material can include tungsten carbide. As used herein, the term "tungsten carbide" means any material composition that contains chemical compounds of tungsten and carbon, such as, for example, WC, W2C, and combinations of WC and W2C. Thus, tungsten carbide includes, for example, cast tungsten carbide, sintered tungsten carbide, and macrocrystalline tungsten. According to additional or alternative implementations of the present invention, the hard particulate material can include carbide, tungsten, iron, cobalt, and/or molybdenum and carbides, borides, alloys thereof, or any other suitable material.

One will appreciate in light of the disclosure herein that the amounts of the various components of infiltrated diamond body 100 can vary depending upon the desired properties. In one or more implementations, the hard particulate material can comprise between about 0% and about 70% by volume of the infiltrated diamond body 100. More particularly, the hard particulate material can comprise between about 20% and about 70% by volume of the infiltrated diamond body 100.

The diamond 102 (and hard particulate material if included) can be infiltrated with a binder 104 as mentioned previously. In one or more implementations the binder material can be a copper-based infiltrant. The binder 104 can function to bind or hold the diamond particles or crystals together. The binder can be tailored to provide the infiltrated diamond body 100 with several different characteristics that can increase the gripping power, the useful life, and/or the wear resistance of the infiltrated diamond body 100. For example, the composition or amount of binder in the infiltrated diamond body 100 can be controlled to vary the ductility of the infiltrated diamond body 100. In this way, the infiltrated diamond body 100 may be custom-engineered to possess optimal characteristics for specific materials or uses.

The binder can comprise between about 5% and about 75% by volume of the infiltrated diamond body 100. More particularly, the binder can comprise between about 20% and about 45% by volume of the infiltrated diamond body 100. For example, a binder 104 of one or more implementations of the present invention can include between about 20% and about 45% by weight of copper, between about 0% to about 15% by weight of manganese, between about 0% and about 15% by weight of nickel, between about 0% and about 20% by weight of silver, between about 0% and about 0.2% by weight of silicon, between about 0% and about 5% by weight of tin, and between about 0% and about 21% by weight of zinc. In the above example, it is understood that ranges including a lower boundary of "about 0%" encompass embodiments in which the component associated with the range is completely excluded from the binder. Alternatively, the binder 104 can comprise a high-strength, high-hardness binder such as those disclosed in U.S. patent application Ser. No. 13/280,977, the entire contents of which are hereby incorporated by reference in their entirety. In one or more implementations, such high-strength, high-hardness binders can allow for a smaller percentage by volume of diamond, while still maintaining increased gripping power and wear resistance.

One or more implementations of the present invention are configured to provide tools that provide effective gripping action and wear resistance. In particular, in one or more implementations such tools are configured to also resist wear, break-up, and erosion. For example, in one or more implementations, the binder is configured to prevent erosion of the infiltrated diamond body during drilling. One will appreciate in light of the disclosure herein that this is in contrast to impregnated tools that are configured to erode to expose new diamond during a drilling process.

Diamond Rollers

As mentioned previously, infiltrated diamond bodies 100 according to one or more implementations of the present invention can form at least part of various different tools. For example, FIGS. 1A and 3A-3E illustrate a roller 200 that can include one or more infiltrated diamond bodies 100. The roller 200 can also include a base portion 204 from which the infiltrated diamond bodies 100 project. More particularly, in exemplary aspects, the infiltrated bodies 100 of the roller 200 can be provided as pads or strips 202 that project outwardly from the base portion 204 to enhance gripping contact with drill rods or other tubulars that are engaged by the roller.

By way of example and not limitation, the base portion 204 may be formed from steel, another iron-based alloy, or any other material that exhibits acceptable physical properties. When considering the entire volume of the roller 200 (i.e., combining the pads 202 and the base portion 204), the roller can include between about 0.1% to about 0.5% by volume of diamond, between about 15% and about 35% by volume of iron, between 15% and about 35% by volume of tungsten, between about 20% and about 40% by volume of copper, and between about 10% and about 30% by volume of zinc. Optionally, the roller can also include trace amounts (less than 1% by volume) of other elements, such as for example and without limitation, nickel, molybdenum, oxygen, carbon.

Figure 3A:
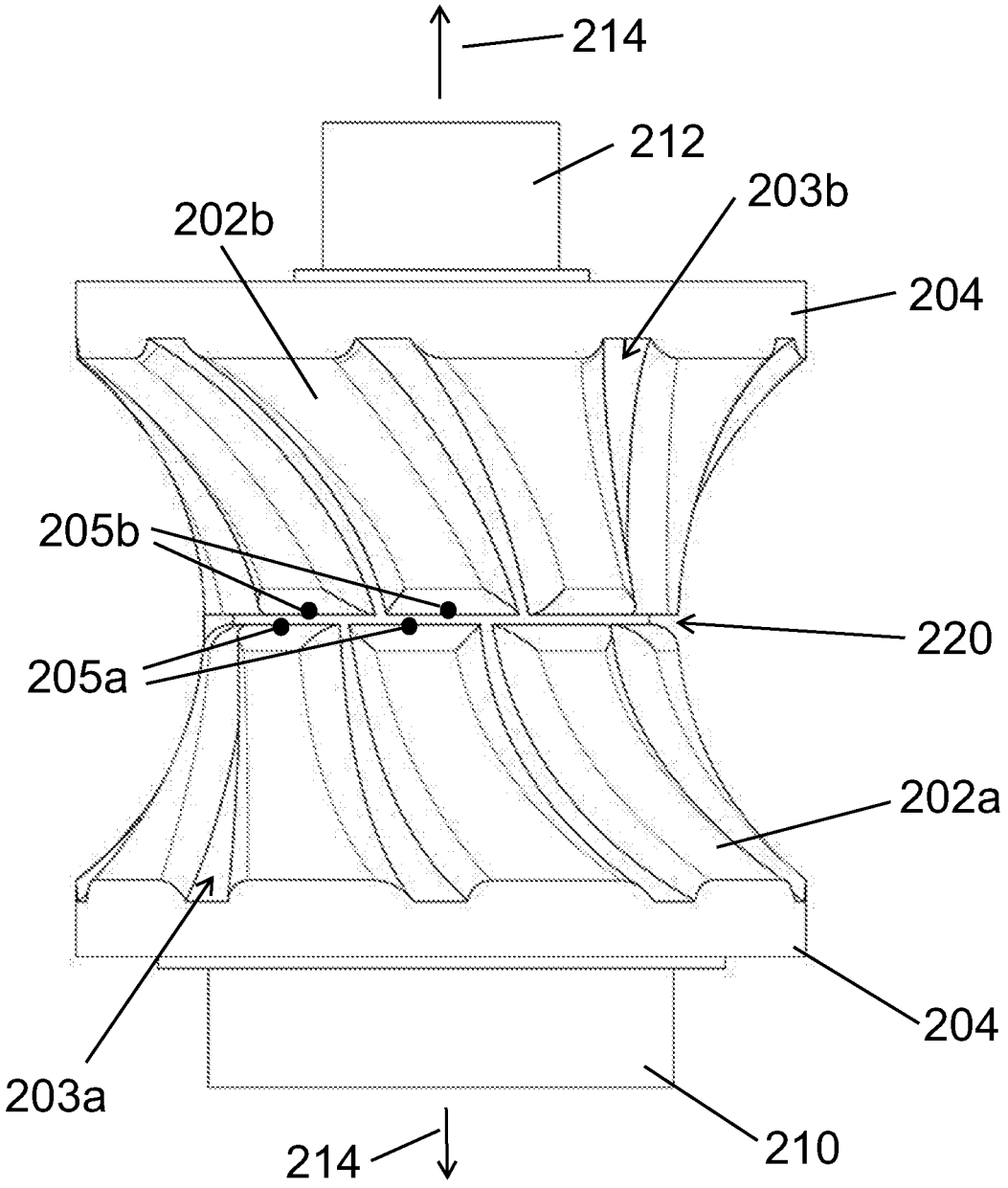
FIG. 3A is a front view of an exemplary diamond roller as disclosed herein.
Figure 3B:
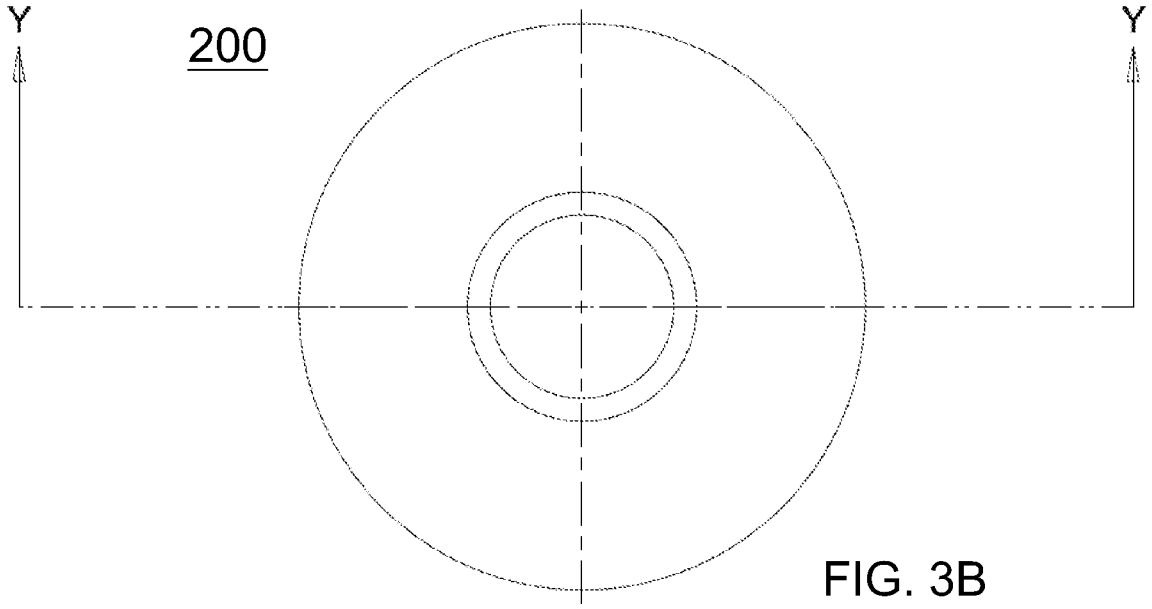
FIG. 3B is a top view of the diamond roller of FIG. 3A.
Figure 3C:
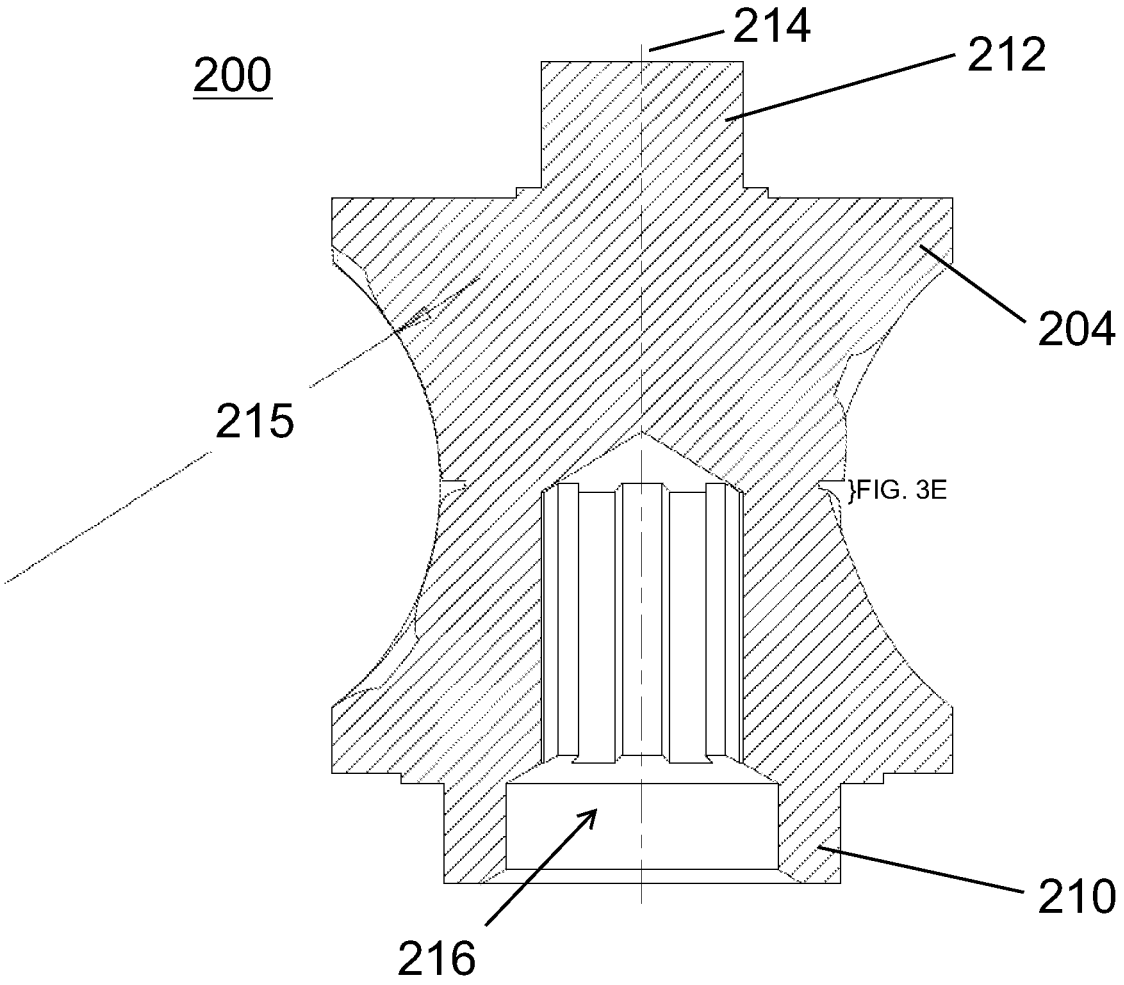
FIG. 3C is a cross-sectional front view of the diamond roller of FIG. 3A, taken at line Y-Y as shown in FIG. 3B.

As shown in FIGS. 1A and 3A-3E, the roller 200 can have a generally concave profile that extends circumferentially about the base portion 204 (and defined at least partially by the projecting pads or strips 202) between opposed first and second end portions 210, 212 that are spaced apart along a longitudinal axis 214 of the roller. In use, it is contemplated that the roller 200 can be configured for rotation about its longitudinal axis to apply gripping force to an outer surface of a drill rod or other tubular. It is further contemplated that the concave profile defined by the roller 200 can be configured to guide a drill rod or other tubular to a central position between the first and second end portions 210, 212 relative to the longitudinal axis 214. In one aspect, and as shown in FIG. 3C, it is contemplated that the first end portion 210 and the base portion 204 of the roller 200 can cooperate to define an interior space 216 that intersects the longitudinal axis 214 and is configured to receive and engage a conventional rod handler mount, such as a spline, a spindle, a rod, or another component that is configured to drive movement of the roller.

As shown by FIGS. 3A-3E, in one or more implementations, the roller 200 can include raised pads 202 separated by channels 203. The raised pads 202 can comprise infiltrated diamond bodies 100 as described herein above. In operation, the channels 203 can be configured to promote movement of grease, thick drilling muds, rock chips, and the like away from the pads 202 (and thus, the diamonds within the pads). In one or more implementations the pads 202 can have a substantially spiral configuration. In other words, the pads 202 can extend axially along the base portion 204 and circumferentially around the base portion 204. The spiral configuration of the pads 202 can provide increased contact with drill rods or other tubulars engaged by the pads. However, it is contemplated that other pad configurations are possible. For example, in alternative implementations, the pads 202 can have a linear instead of a spiral configuration. In such implementations, the pads 202 can extend axially along the base portion 204.

Optionally, the pads 202 can be provided with additional surface features to increase grip strength. Exemplary surface features include surface roughness, grooves, ribs, projections, and combinations thereof. Such surface features can be provided in any desired arrangement or pattern. Optionally, when ribs or projections are provided, it is contemplated that the ribs or projections can be infiltrated as one piece with the pads 202 and formed from the same material. Optionally, when grooves are formed into the outer surface of the pads, the grooves can be oriented parallel or substantially parallel to a longitudinal axis of the drill rod (or other tubular) that is gripped by the pads.

The roller 200 may be any size, and therefore, may be used to grip, transport, and otherwise engage drill rods of any size. In exemplary aspects, as shown in FIG. 3C, within a plane containing the longitudinal axis 214, it is contemplated that the outer surfaces of the raised pads 202 can cooperate to define a selected radius of curvature 215 to produce the concave profile of the base portion 204. Optionally, in these aspects, the selected radius of curvature 215 can range from about 2 inches to about 3.5 inches and more preferably, from about 2.6 inches to about 3.0 inches. In some exemplary aspects, the selected radius of curvature 215 can range from about 2.75 inches to about 2.85 inches. It is contemplated that the radii of curvature disclosed herein can be selected to optimize surface contact with drill rods and other tubulars.

In further exemplary aspects, it is contemplated that the plurality of pads 202 can comprise a first set of pads 202*a* and a second set of pads 202*b* separated from the first set of pads 202*a* relative to the longitudinal axis 214. In these aspects, the first and second sets of pads 202*a*, 202*b* can be separated by a circumferential gap 220 that extends around the base portion 204 as shown in FIG. 3A. It is contemplated that the gap 220 can correspond to a selected longitudinal distance, such as for example and without limitation about 0.05 inches. In use, the gap 220, which is positioned in fluid communication with each channel 203, can cooperate with the channels to promote movement of grease, thick drilling muds, rock chips, and the like away from the pads 202 (and thus, the diamonds within the pads). It is further contemplated that the first set of pads 202*a* can be separated by respective channels 203*a*, while the second set of pads 202*b* can be separated by its own respective channels 203*b*. In exemplary aspects, each pad and channel can move in accordance with a partial spiral profile, with each pad and each channel extending axially along the base portion 204 and circumferentially around the base portion 204. As shown in FIG. 3A, each channel 203*a*, 203*b* can have a first diameter proximate the gap 220 and a second, larger diameter at an opposing end of the channel (proximate the first end 210 in the case of channels 203*a* and proximate the second end 212 in the case of channels 203*b*). Thus, in addition to having a spiral configuration, each channel 203*a*, 203*b* can also have a tapered profile in which the circumferential width (width measured relative to the circumference of the base portion) increases moving away from the gap 220 and toward the respective end portions 210, 212. In use, it is contemplated that the described channels 203*a*, 203*b* can be configured to provide ideal grease flow during drill rod transport.

Figure 3D:
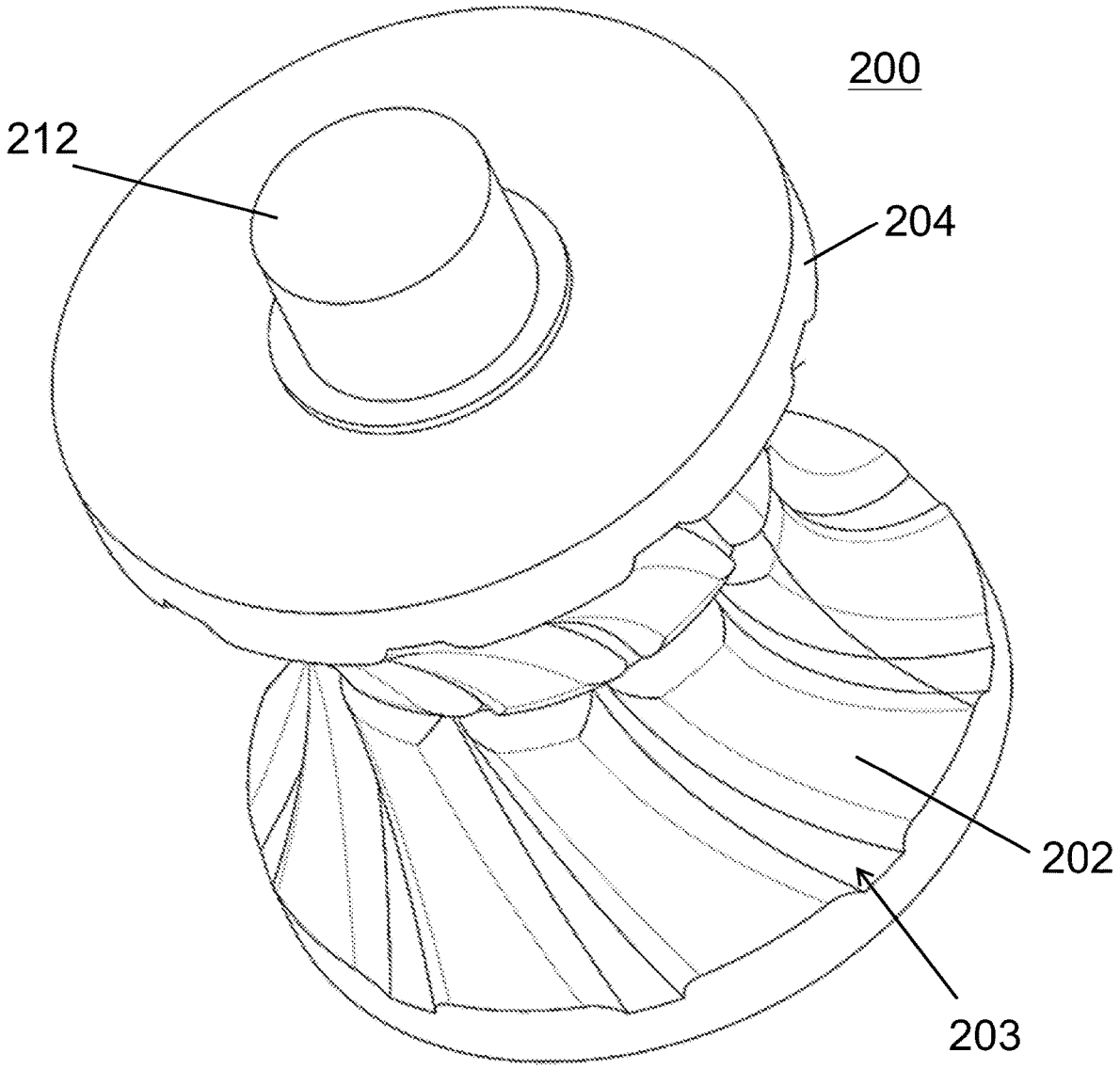
FIG. 3D is a top perspective view of the diamond roller of FIG. 3A.

An exemplary spiral configuration of the first and second sets of pads 202*a*, 202*b* is depicted in FIGS. 3A and 3D. As shown, each pad 202*a* of the first set of pads and each channel 203*a* of the first set of channels can extend circumferentially in a first direction (relative to the circumference of the roller 200) as the pad and the channel approach gap 220. Optionally, each pad 202*b* of the second set of pads and each channel 203*b* of the second set of channels can extend circumferentially in the first direction. However, in other optional aspects, each pad 202*b* of the second set of pads and each channel 203*b* of the second set of channels can extend circumferentially in a second direction (relative to the circumference of the roller 200) that is opposite the first direction.

In still further exemplary aspects, and as shown in FIG. 3A, the first set of pads 202*a* can be circumferentially offset from one another by a selected amount (e.g., a selected angular amount measured relative to the circumference of the roller 200), and the second set of pads 202*b* can be circumferentially offset from one another by a selected amount (e.g., a selected angular amount measured relative to the circumference of the roller 200). In exemplary aspects, it is contemplated that the circumferential offset between respective sequential pads can be measured or determined by comparing center points 205*a*, 205*b* (or other common reference points) of the pads relative to the circumference of the roller within a plane perpendicular to the longitudinal axis 214. In these aspects, it is contemplated that each set of pads can comprise any desired number of pads, ranging, without limitation, from 3 to 16 or from 5 to 12 pads. For example, it is contemplated that the pads of the first set of pads 202*a* can comprise nine pads that are circumferentially offset from sequentially circumferentially positioned pads by about 36 degrees. Similarly, it is contemplated that the pads of the second set of pads 202*b* can comprise nine pads that are circumferentially offset from sequentially circumferentially positioned pads by about 36 degrees. In other exemplary aspects, it is contemplated that the number of pads in the first set of pads can be less than, equal to, or greater than the number of pads in the second set of pads.

In these exemplary aspects, it is further contemplated that the ends of the first pads 202*a* that are proximate the gap 220 can be circumferentially offset from the ends of the second pads 202*b* that are proximate the gap, thereby providing a staggered configuration that avoids alignment between gripping features along the entire axial length of the roller as is found in conventional rollers. Thus, it is contemplated that this circumferential offset between the first and second pads 202*a*, 202*b* can avoid or reduce problems associated with skipping and rod damage as are typical with conventional rollers. Optionally, in exemplary aspects, where the number of first pads 202*a* is equal to the number of second pads 202*b*, the first pads can be circumferentially offset from the second pads by a selected angle equal to one half of the angular separation between sequential first pads. For example, in the above-described configuration in which the first pads are separated from one another by about 36 degrees, it is contemplated that the first pads can be circumferentially offset from the second pads by about 18 degrees.

Figure 3E:
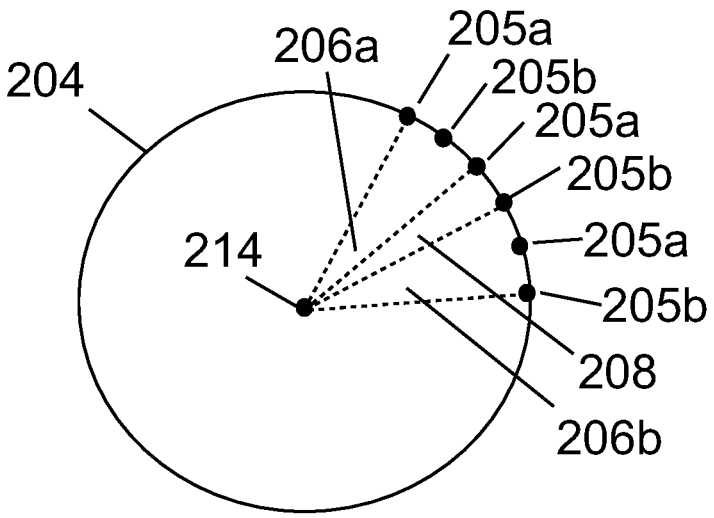
FIG. 3E is a schematic top view of an isolated section of the diamond roller of FIG. 3A (section labeled in FIG. 3C), showing the relative circumferential locations of center points of respective pads of the first and second sets of pads of the diamond roller as disclosed herein.

FIG. 3E schematically depicts the relative angular position of respective center points 205*a*, 205*b* of leading edges of the first and second sets of pads 202*a*, 202*b* at the locations where the leading edges meet gap 220. The center points can correspond to the midpoint of the circumferential length of the leading edge that meets the outer surface of the roller 200 at gap 220. The angle between sequential center points 205*a* of the first set of pads is represented as angle 206*a*, and the angle between sequential center points 205*b* of the second set of pads is represented as angle 206*b*. In exemplary aspects, when the first or second sets of pads are respectively equally circumferentially spaced, it is contemplated that angles 206*a*, 206*b* can range from about 21 to about 90 degrees (corresponding to 3-16 pads per set) or from about 24 to about 60 degrees (corresponding to 7-14 pads per set) or from about 30 to about 40 degrees (corresponding to 8-11 pads per set) or, as disclosed in the above example, be about 36 degrees (corresponding to 9 pads per set). The angle between sequential center points 205*a*, 205*b* of circumferentially overlapping pads of the first and second sets of pads is represented as angle 208. As discussed above, in exemplary aspects, when the first and second sets of pads are evenly circumferentially spaced about the circumference of the roller 200, angle 208 can be equal to half of angle 206*a* and 206*b*. However, in other exemplary aspects, it is contemplated that the first set of pads can be unevenly spaced about the circumference of the roller and/or have inconsistent sizes or shapes. Additionally, or alternatively, it is contemplated that the second set of pads can be unevenly spaced about the circumference of the roller and/or have inconsistent sizes or shapes. In these aspects in which one or both sets of pads have uneven circumferential spacing or inconsistent sizes or shapes, it is contemplated that the values of angles 206*a*, 206*b*, 208 can likewise vary about the circumference of the roller.

While specific angular measurements have been provided above, it is understood that other angular measurements can be used depending upon the number of pads and channels provided. For example, assuming evenly spaced and equally sized pads, should additional pads and channels be provided (such as a total of 10, 11, 12, 13, 14, 15, or 16 pads), then the circumferential offset between sequential pads will be reduced. On the other hand, should fewer pads and channels be provided (such as a total of 3, 4, 5, 6, 7, or 8 pads), then the circumferential offset between sequential pads will be increased.

In use, it is contemplated that the presence of the gap 220 and the staggering of the first and second sets of pads 202*a*, 202*b* can maintain the effectiveness of the gripping pads after wear. In contrast to the disclosed configuration, a continuous gripping surface along the entire length of the roller would not be as effective once worn.

Optionally, the base portion 204 can comprise steel or another suitable material that is formed with the pads (infiltrated diamond bodies) in a single casting process. For example, it is contemplated that at least a portion of the base portion 204 (optionally, the entire base portion or the entire roller) and the pads 202 of the roller can be provided together and infiltrated as one piece. Optionally, when it is desired to include diamond throughout the base portion, then it is contemplated that the base portion 204 and the pads 202 can form a single infiltrated diamond body as disclosed herein.

Optionally, the infiltrated diamond bodies 100 can be configured as substrates that line or coat various features of a tool. For example, in one or more implementations the base portion 204 of the roller 200 can comprise an outer substrate or layer formed from an infiltrated diamond body 100. In these aspects, it is contemplated that an infiltrated diamond body 100 can be brazed or soldered to the base portion 204. Alternatively or additionally, the infiltrated diamond body or substrate 100 can be mechanically secured to the base portion 204. One will appreciate in light of the disclosure herein that the infiltrated diamond body can be secured to any portion of the tools described herein above to increase the gripping power thereof.

Diamond Wrench Jaws

Figure 4A:
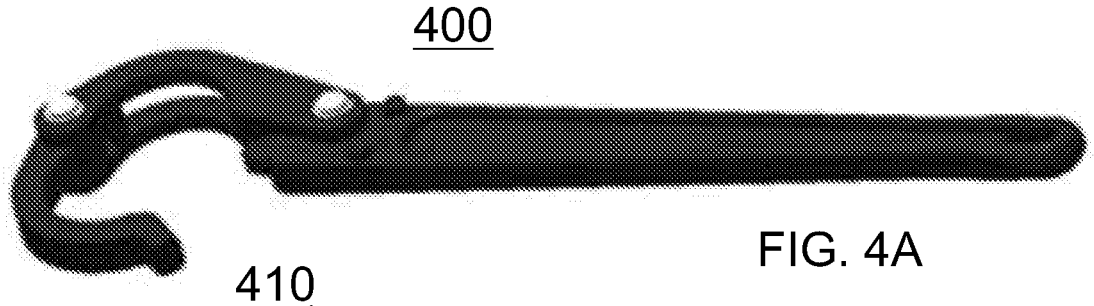
FIG. 4A is a top perspective view of an exemplary wrench in a fully assembled condition.
Figure 4B:
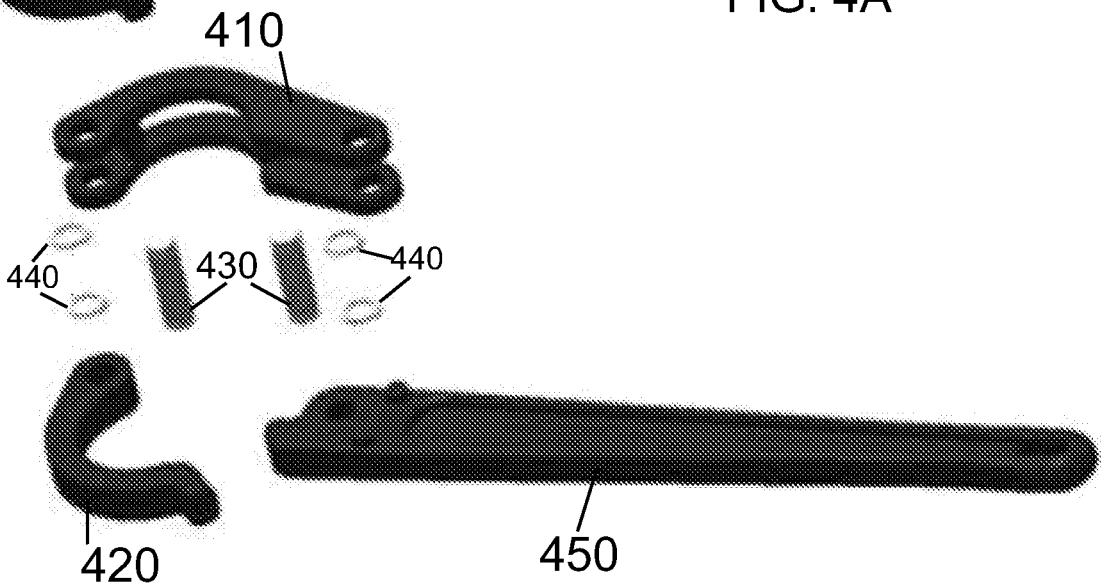
FIG. 4B is an exploded view of the components of the wrench of FIG. 4A.
Figure 5A:
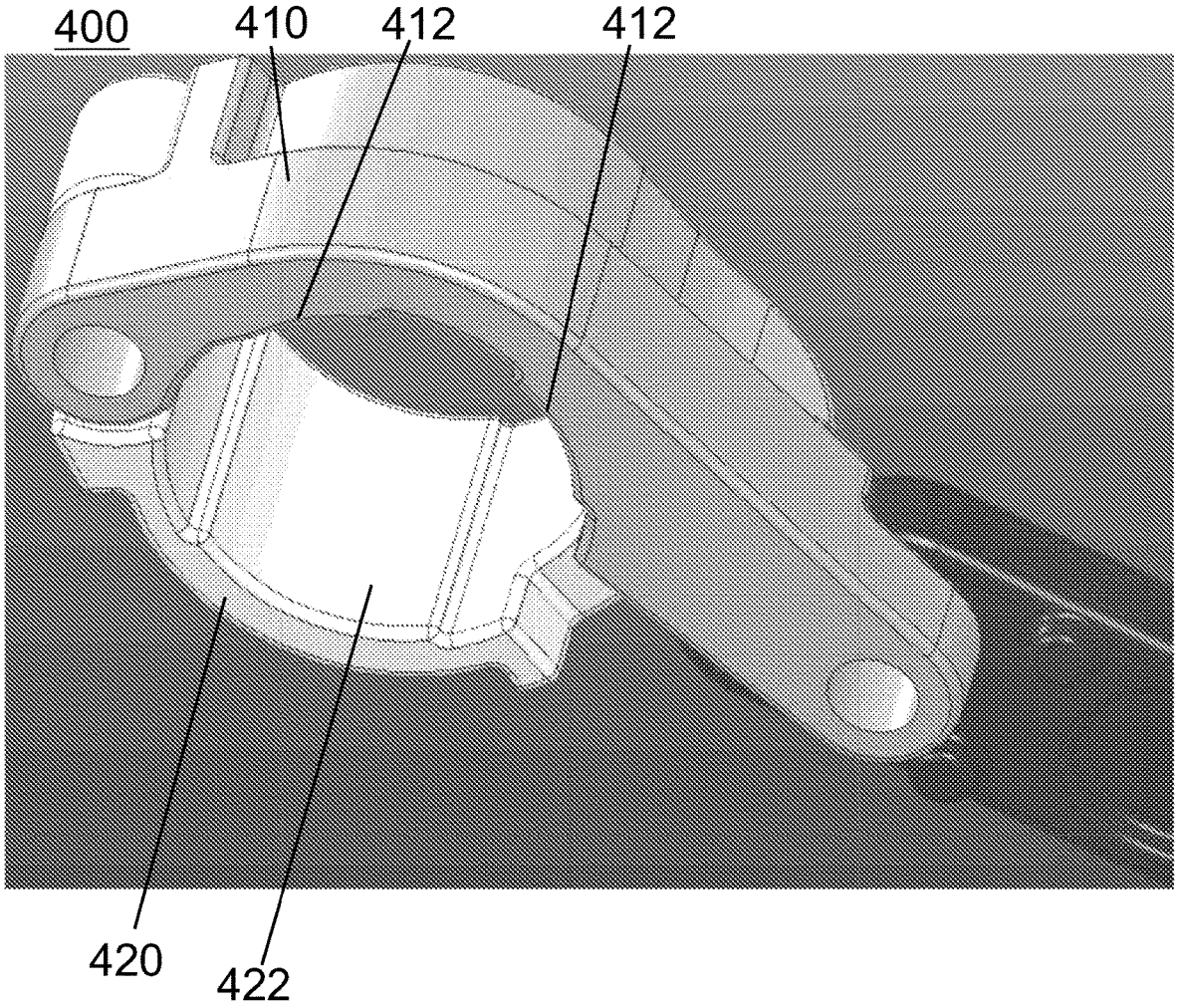
FIG. 5A is a top perspective view of exemplary diamond jaws of a wrench as disclosed herein.
Figure 5B:
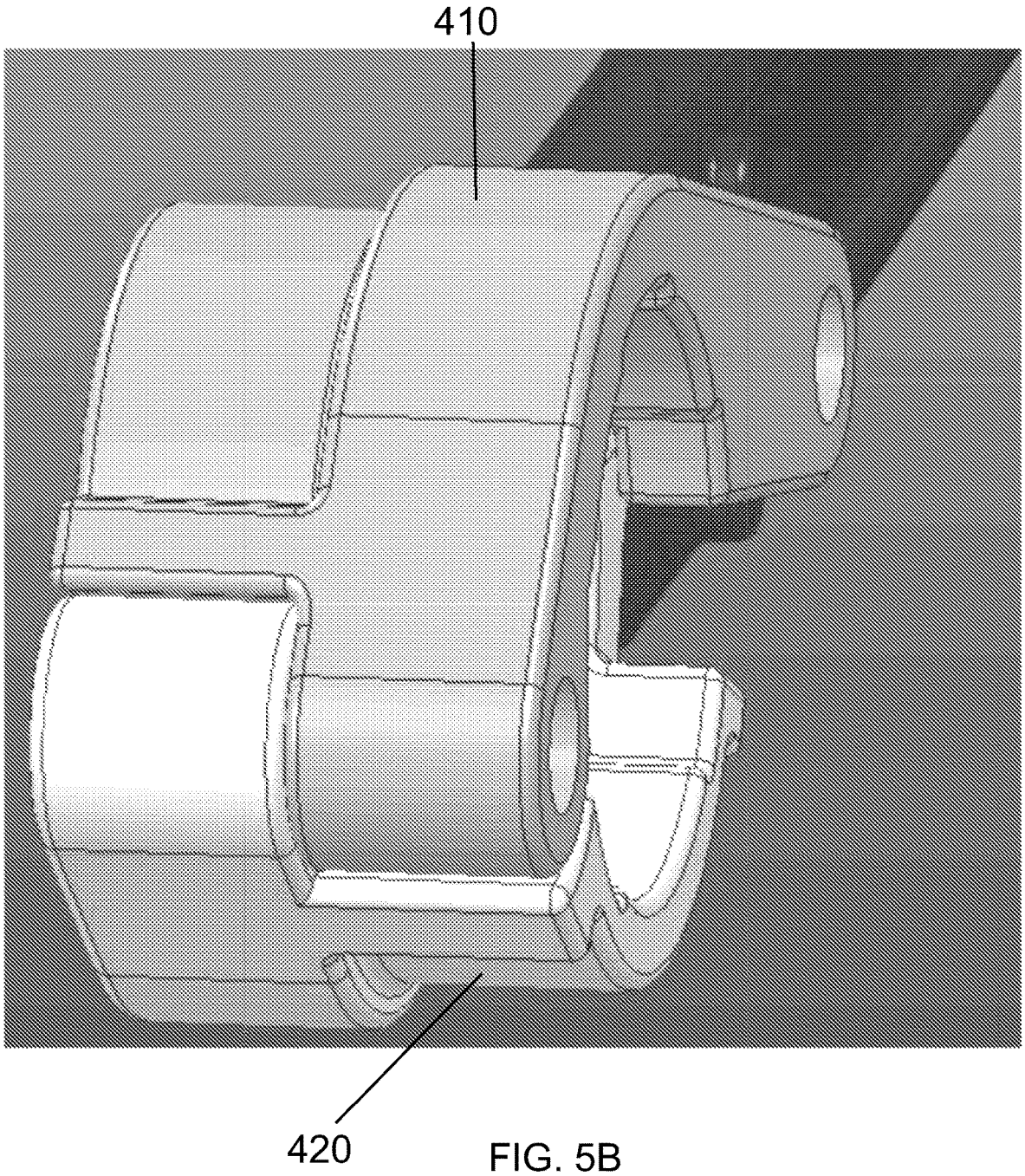
FIG. 5B is a side perspective view of the diamond jaws of FIG. 5A.
Figure 6:
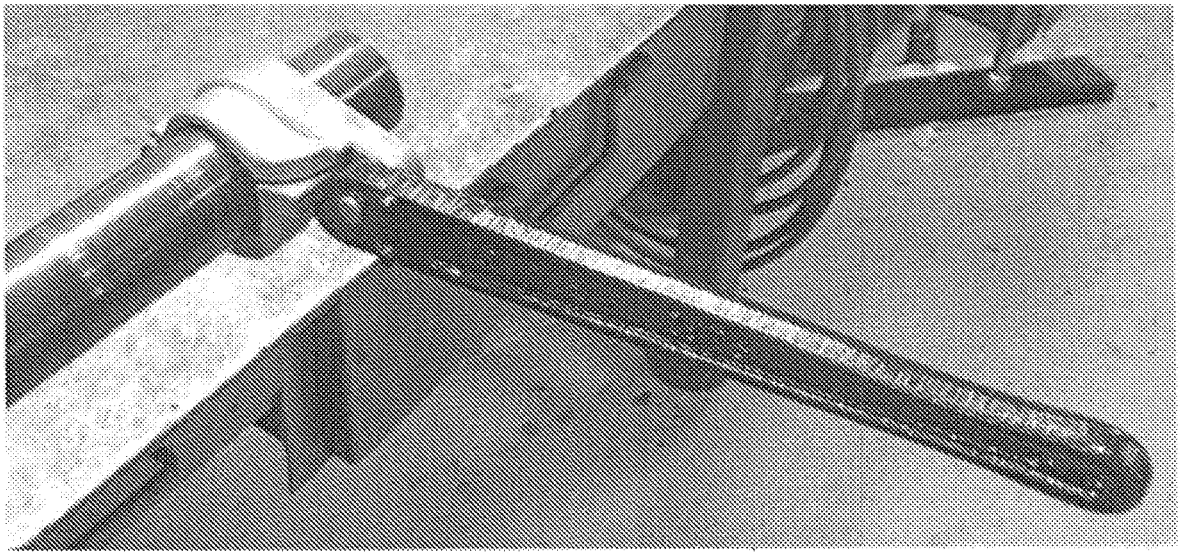
FIG. 6 is an image depicting use of a wrench having diamond jaws as disclosed herein.
Figure 7:
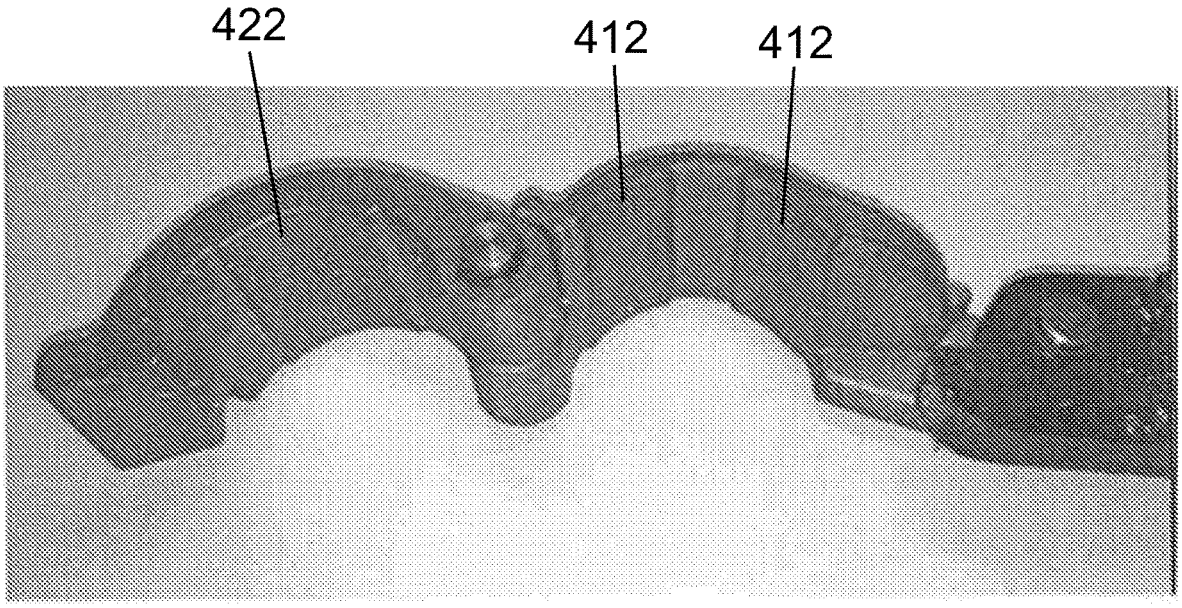
FIG. 7 is an image depicting diamond jaws of a wrench in an open position as disclosed herein.
Figure 8:
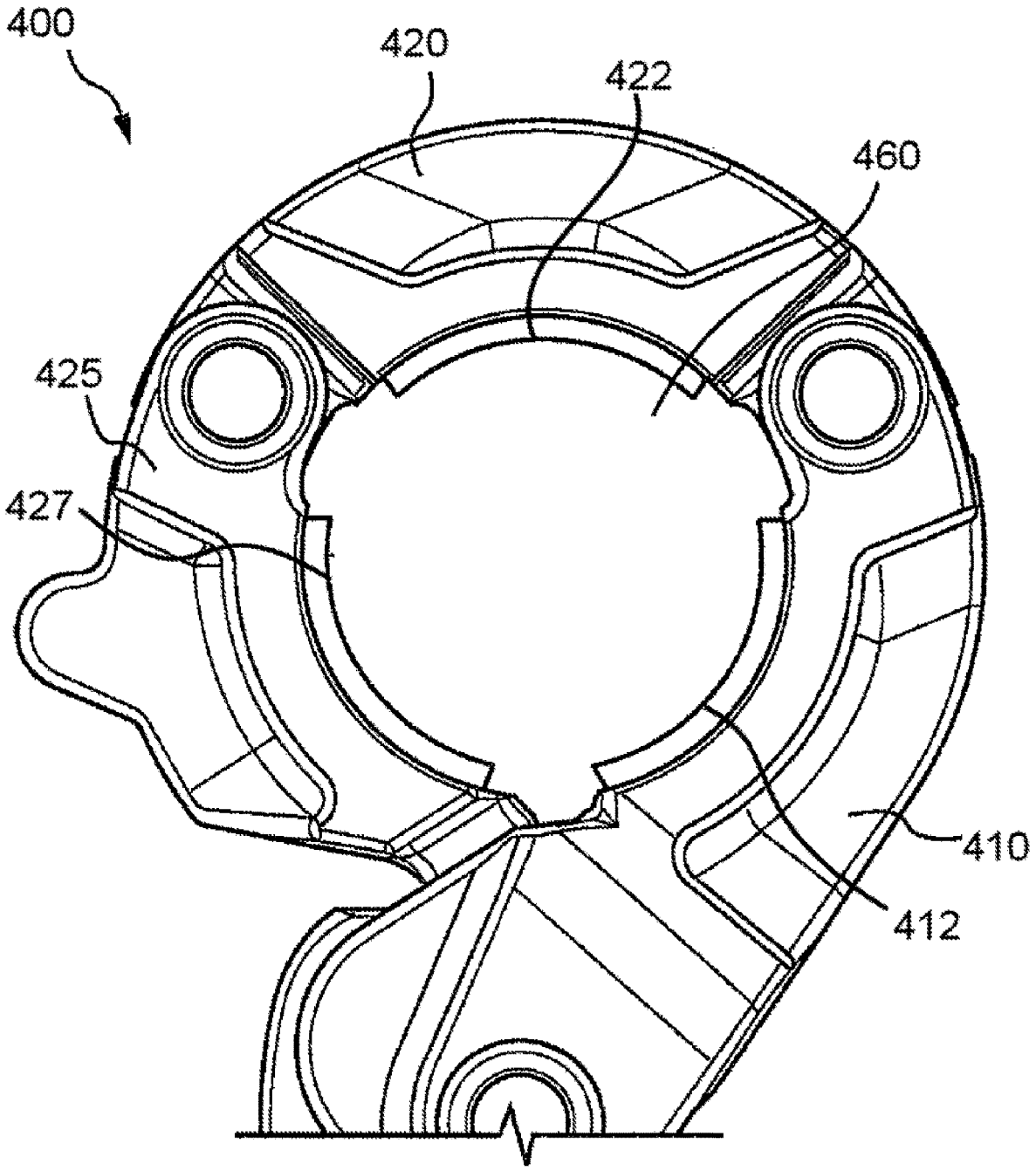
FIG. 8 is a side view of an exemplary wrench having three diamond jaws as disclosed herein.

One will appreciate in light of the disclosure herein that rollers 200 are only one type of tool with which the disclosed infiltrated diamond bodies 100 may be used. For example, FIGS. 4A-8 illustrate a wrench 400 including one or more infiltrated diamond bodies 100. As shown in FIGS. 4A-4B, the wrench 400 can include at least two jaw portions (i.e., at least first and second jaw portions 410, 420). The first jaw portion 410 can be pivotally secured to a handle 450 by a first pin 430 and a first set of retaining rings 440. The second jaw portion 420 can be pivotally secured to the first jaw portion 410 using a second pin 430 and a second set of retaining rings 440. Optionally, as shown in FIG. 8, the wrench 400 can include a third jaw portion 425, which can be pivotally secured to the second jaw portion 420. In use, the first jaw portion 410 can function as a "stationary" jaw, while the second jaw portion 420 can function as a "swing" jaw as is known in the art. More particularly, the first jaw portion 410 can be positioned such that its inner surface engages a drill rod or other tubular. The wrench user can then swing the wrench 400 such that the second jaw portion "swings" around the engaged drill rod and circumferentially encloses the drill rod within the inner surfaces of the first and second jaw portions 410, 420. In alternative configurations in which a third jaw portion 425 is provided, it is contemplated that the second and third jaw portions 420, 425 can both "swing" around the engaged drill rod to circumferentially enclose the drill rod within an interior space 460 defined by the inner surfaces of the three jaw portions.

In exemplary aspects, it is contemplated that the inner surfaces of the first and second jaw portions 410, 420 can include respective infiltrated diamond bodies 100 that can be provided as gripping pads 412, 422. More particularly, in exemplary aspects, the infiltrated bodies 100 of the wrench 400 can be provided as pads or strips 412, 422 that project inwardly from the first and second jaw portions 410, 420 to enhance gripping contact with drill rods or other tubulars that are engaged by the wrench. Optionally, as shown in FIGS. 5A-7, it is contemplated that the first jaw portion 410 can comprise two spaced gripping pads 412, whereas the second jaw portion 420 can comprise a single gripping pad 422. In alternative configurations in which three jaw portions are provided as shown in FIG. 8, it is contemplated that each jaw portion 410, 420, 425 can comprise a respective gripping pad 412, 422, 427 (for a total of three gripping pads). In operation, when the wrench 400 is in a fully closed position (for engaging a drill rod), the gripping pads 412, 422 (and 427, when provided) can provide three circumferentially spaced contact areas for the drill rod or other tubular engaged by the wrench. Optionally, in exemplary aspects, the gripping pads 412, 422 (and 427, when present) can be positioned to be equally or substantially equally spaced about the circumference of the drill rod when the first and second jaw portions 410, 420 (and third jaw portion 425, when present) are in the fully closed position. In use, it is contemplated that the spacing of the gripping pads 412, 422 (and 427, when provided) can provide a self-centering function and apply a balanced gripping force to the drill rod while also maintaining the effectiveness of the gripping pads after wear (a continuous circumferential gripping surface would not be as effective once worn).

Optionally, the gripping pads 412, 422, 427 can be provided with additional surface features to increase grip strength. Exemplary surface features include surface roughness, grooves, ribs, projections, and combinations thereof. Such surface features can be provided in any desired arrangement or pattern. Optionally, when ribs or projections are provided, it is contemplated that the ribs or projections can be infiltrated as one piece with the gripping pads 412, 422, 427 and formed from the same material. Optionally, when grooves are formed into the outer surface of the gripping pads, the grooves can be oriented parallel or substantially parallel to a longitudinal axis of the drill rod (or other tubular) that is gripped by the gripping pads.

Optionally, portions of the jaw portions 410, 420, 425 other than the gripping pads can comprise steel or another suitable material that is formed with the gripping pads (the infiltrated diamond bodies) in a single casting process. For example, it is contemplated that at least a portion of each jaw portion (optionally, the entire jaw portion) and the gripping pads of the jaw portion can be provided together and infiltrated as one piece. Optionally, when it is desired to include diamond throughout the jaw portion, then it is contemplated that the jaw portion and the gripping pads extending from the jaw portion can form a single infiltrated diamond body as disclosed herein.

Optionally, in one or more implementations the jaw portions of the wrench 400 can comprise an outer substrate or layer formed from an infiltrated diamond body 100. In these aspects, it is contemplated that an infiltrated diamond body 100 can be brazed or soldered to the jaw portions. Alternatively or additionally, the infiltrated diamond body or substrate 100 can be mechanically secured to each jaw portion. One will appreciate in light of the disclosure herein that the infiltrated diamond body can be secured to any portion of the wrench to increase the gripping power thereof.

Methods of Making the Infiltrated Diamond Bodies

Implementations of the present disclosure also include methods of forming tools including infiltrated diamond bodies. The following describes at least one method of forming tools including infiltrated diamond bodies. Of course, as a preliminary matter, one of ordinary skill in the art will recognize that the methods explained in detail can be modified.

As an initial matter, the term "infiltration" or "infiltrating" as used herein involves melting a binder material and causing the molten binder to penetrate into and fill the spaces or pores of a matrix. Upon cooling, the binder can solidify, binding the particles of the matrix together.

For example, a method of forming a gripping tool can initially comprise preparing a matrix, for example, preparing a matrix of diamond and a hard particulate material as disclosed herein. For example, preparing a matrix can comprise dispersing a plurality of diamond particles throughout a hard particulate material. More particularly, this step can comprise preparing a matrix of a powdered material, such as for example tungsten carbide, and dispersing diamond particles 102 therein. In additional implementations, the matrix can comprise one or more of the previously described hard particulate materials or diamond materials. Additionally, the method can involve dispersing the diamond 102 randomly or in an unorganized arrangement throughout the matrix. Preparing the matrix can involve dispersing sufficient diamond 102 throughout the matrix such that the diamond 102 comprises at least 25 percent by volume of the matrix. In additional implementations, the matrix comprises between about 25% and 75% diamond.

The method can further comprise shaping the matrix into a desired shape. In one or more implementations of the present disclosure, this step can include placing the matrix in a mold. The mold can be formed from a material that is able to withstand the heat to which the matrix will be subjected to during a heating process. In at least one implementation, the mold may be formed from carbon. The mold can be shaped to form a tool having desired features. In at least one implementation of the present invention, the mold can correspond to a roller or a wrench jaw or other tool.

The method can further comprise infiltrating the diamond matrix with a binder. This step can involve heating the binder to a molten state and infiltrating the diamond matrix with the molten binder. For example, in some implementations the binder can be placed proximate the diamond matrix and the diamond matrix and the binder can be heated to a temperature sufficient to bring the binder to a molten state, at which point the molten binder can infiltrate the diamond matrix. In one or more implementations, infiltrating the diamond matrix can include heating the diamond matrix and the binder to a temperature of at least 787 degrees Fahrenheit.

In exemplary aspects, the binder can comprise copper, zinc, silver, molybdenum, nickel, cobalt, tin, iron, aluminum, silicon, manganese, or mixtures and alloys thereof. The binder can cool, thereby bonding to the diamond 102 and the hard particulate material and binding them together. According to one or more implementations of the present disclosure, the time and/or temperature of the infiltration process can be increased to allow the binder to fill-up a greater number and greater amount of the pores of the diamond matrix. This can both reduce the shrinkage during sintering, and increase the strength of the resulting tool.

The method can further comprise an act of cooling the infiltrated diamond matrix to form an infiltrated diamond body 100, such as a pad 202 or wrench jaw 410, 420 as disclosed herein. When the infiltrated diamond body is no infiltrated with other portions of a tool as a single piece, the method can further involve securing the infiltrated diamond body 100 to the tool or a portion thereof using conventional methods.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A gripping tool comprising: at least one cast gripping portion, wherein each cast gripping portion comprises: a matrix having a hard particulate material and a plurality of diamond particles dispersed throughout the hard particulate material; and a binder that secures the hard particulate material and the diamond particles together, wherein the diamond particles comprise between about 25% by volume and about 75% by volume of each cast gripping portion.

Aspect 2: The gripping tool of aspect 1, wherein the gripping tool is a gripping roller having a base portion, and wherein the at least one cast gripping portion comprises a plurality of contact pads positioned on an outer surface of the base portion the gripping roller.

Aspect 3: The gripping tool of aspect 2, wherein the base portion of the gripping roller is cast together with the plurality of contact pads to form a single unitary structure.

Aspect 4: The gripping tool of aspect 2 or aspect 3, wherein the gripping roller comprises: between about 0.1% to about 0.5% by volume of diamond; between about 15% and about 35% by volume of iron; between about 15% and about 35% by volume of tungsten; between about 20% and about 40% by volume of copper; and between about 10% and about 30% by volume of zinc.

Aspect 5: The gripping tool of any one of aspects 2-4, wherein the gripping roller has opposed first and second end portions that are spaced apart along a longitudinal axis of the roller, and wherein the plurality of contact pads at least partially define a concave profile extending circumferentially about the base portion between the first and second end portions of the gripping roller, wherein the concave profile is configured to guide a drill rod to a central position between the first and second end portions.

Aspect 6: The gripping tool of any one of aspects 2-5, wherein the plurality of contact pads are separated by a plurality of channels.

Aspect 7: The gripping tool of any one of aspects 2-6, wherein the plurality of contact pads have a spiral or substantially spiral configuration in which the pads extend axially along the base portion and circumferentially around the base portion.

Aspect 8: The gripping tool of any one of aspects 5-7, wherein the concave profile has a radius of curvature ranging from about 2 inches to about 3.5 inches.

Aspect 9: The gripping tool of any one of aspects 2-8, wherein the plurality of contact pads comprises a first set of pads and a second set of pads separated from the first set of pads relative to the longitudinal axis, wherein the first set of pads is separated from the second set of pads by a circumferential gap that extends around the base portion of the gripping roller.

Aspect 10: The gripping tool of aspect 9, wherein each pad and each channel have a partial spiral profile in which each pad and each channel extends both axially and circumferentially around the base portion.

Aspect 11: The gripping tool of aspect 9 or aspect 10, wherein each channel has a tapered profile in which a circumferential width of the channel increases moving away from the gap and toward a respective end portion of the gripping roller.

Aspect 12: The gripping tool of any one of aspects 9-11, wherein the first set of pads, the second set of pads, a first set of channels separating the first set of pads, and a second set of channels separating the second set of pads all extend circumferentially in a first direction approaching the gap.

Aspect 13: The gripping tool of any one of aspects 9-11, wherein the first set of pads and a first set of channels separating the first set of pads extend circumferentially in a first direction approaching the gap, and wherein the second set of pads and a second set of channels separating the second set of pads extend circumferentially in a second direction approaching the gap, wherein the second direction is different than the first direction.

Aspect 14: The gripping tool of any one of aspects 9-13, wherein the first set of pads are equally circumferentially offset from one another.

Aspect 15: The gripping tool of aspect 14, wherein the second set of pads are equally circumferentially offset from one another.

Aspect 16: The gripping tool of aspect 14 or aspect 15, wherein the second set of pads are circumferentially offset from the first set of pads.

Aspect 17: A method of making the gripping tool of any one of claims 2-16.

Aspect 18: The gripping tool of aspect 1, wherein the gripping tool is a wrench having at least two jaws, and wherein the at least one gripping portion comprises three gripping pads positioned on the at least two jaws.

Aspect 19: The gripping tool of aspect 18, wherein the at least two jaws comprises: a first jaw that is cast together with first and second gripping pads of the three gripping pads; and a second jaw that is cast together with a third gripping pad of the three gripping pads.

Aspect 20: The gripping tool of aspect 18, wherein the at least two jaws comprises first, second, and third jaws, wherein each jaw is cast together with a respective gripping pad.

Aspect 21: A method of making the gripping tool of any one of claims 18-20.

The preceding disclosure provides a number of unique products that can be effective for drilling or other tools. Additionally, such products can have an increased wear resistance due to the relatively large concentration of diamond.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A tool comprising:

a base portion; and at least one cast gripping portion, wherein the base portion and the at least one cast gripping portion are defined by a single infiltrated body, the infiltrated body being formed from a cast mixture, the cast mixture comprising:

a matrix having a hard particulate material extending throughout the base portion and the at least one cast gripping portion; and a plurality of diamond particles dispersed within at least a portion of the hard particulate material; and a binder that secures the hard particulate material and the diamond particles together, wherein the diamond particles comprise between about 25% by volume and about 75% by volume of each cast gripping portion, wherein the tool is a gripping roller, and wherein the at least one cast gripping portion comprises a plurality of contact pads positioned on an outer surface of the base portion of the gripping roller, and wherein the base portion and the at least one cast gripping portion are cast together to form the infiltrated body.

2. The tool of claim 1, wherein the gripping roller comprises:

between about 0.1% to about 0.5% by volume of diamond;

between about 15% and about 35% by volume of iron;

between about 15% and about 35% by volume of tungsten;

between about 20% and about 40% by volume of copper; and between about 10% and about 30% by volume of zinc.

3. The tool of claim 1, wherein the gripping roller has opposed first and second end portions that are spaced apart along a longitudinal axis of the roller, and wherein the plurality of contact pads at least partially define a concave profile extending circumferentially about the base portion between the first and second end portions of the gripping roller, wherein the concave profile is configured to guide a drill rod to a central position between the first and second end portions.

4. The tool of claim 3, wherein the plurality of contact pads are separated by a plurality of channels.

5. The tool of claim 4, wherein the plurality of contact pads have a spiral or substantially spiral configuration in which the pads extend axially along the base portion and circumferentially around the base portion.

6. The tool of claim 4, wherein the plurality of contact pads comprises a first set of pads and a second set of pads separated from the first set of pads relative to the longitudinal axis, wherein the first set of pads is separated from the second set of pads by a circumferential gap that extends around the base portion of the gripping roller.

7. The tool of claim 6, wherein each pad and each channel have a partial spiral profile in which each pad and each channel extends both axially and circumferentially around the base portion.

8. The tool of claim 7, wherein each pad and each channel have a partial spiral profile in which each pad and each channel extends circumferentially around the base portion in a common angular direction from a first end portion to a second end portion.

9. The tool of claim 6, wherein each channel has a tapered profile in which a circumferential width of the channel increases moving away from the gap and toward a respective end portion of the gripping roller.

10. The tool of claim 6, wherein the first set of pads, the second set of pads, a first set of channels separating the first set of pads, and a second set of channels separating the second set of pads all extend circumferentially in a first direction approaching the gap.

11. The tool of claim 6, wherein the first set of pads and a first set of channels separating the first set of pads extend circumferentially in a first direction approaching the gap, and wherein the second set of pads and a second set of channels separating the second set of pads extend circumferentially in a second direction approaching the gap, wherein the second direction is different than the first direction.

12. The tool of claim 6, wherein the first set of pads are equally circumferentially offset from one another.

13. The tool of claim 12, wherein the second set of pads are equally circumferentially offset from one another.

14. The tool of claim 12, wherein the second set of pads are circumferentially offset from the first set of pads.

15. The tool of claim 3, wherein the concave profile has a radius of curvature ranging from about 2 inches to about 3.5 inches.

16. The tool of claim 1, wherein the at least one gripping portion of the tool is configured to grip a surface of an object to inhibit relative movement between the tool and the surface of the object.

17. The tool of claim 1, wherein a concentration of the plurality of diamond particles in the at least one cast gripping portion varies throughout the at least one cast gripping portion.

18. The tool of claim 1, wherein the diamond particles are dispersed within the base portion and the at least one cast gripping portion of the single infiltrated body.

19. A tool comprising:

at least two jaws; and three gripping pads, each gripping pad of the three gripping pads positioned on one of the at least two jaws, wherein the tool is a wrench, and wherein each jaw of the at least two jaws and each gripping pad positioned thereon are defined by a respective infiltrated body, said infiltrated body being formed from a cast mixture, the cast mixture comprising:

a matrix having a hard particulate material extending throughout said jaw and each gripping pad positioned thereon;

a plurality of diamond particles dispersed within at least a portion of the hard particulate material; and a binder that secures the hard particulate material and the diamond particles together, wherein the diamond particles comprise between about 25% by volume and about 75% by volume of each cast gripping pad, wherein each jaw of the at least two jaws and each gripping pad positioned on said jaw are cast together to form the respective infiltrated body.

20. The tool of claim 19, wherein the at least two jaws comprises:

a first jaw that is cast together with first and second gripping pads of the three gripping pads; and a second jaw that is cast together with a third gripping pad of the three gripping pads.

21. The tool of claim 19, wherein the at least two jaws comprises first, second, and third jaws, wherein each jaw is cast together with a respective gripping pad.

* * * * *